US011964216B2

(12) United States Patent
Feng

(10) Patent No.: US 11,964,216 B2
(45) Date of Patent: Apr. 23, 2024

(54) SURFACE GRID PANEL ASSEMBLY

(71) Applicant: Xudong Feng, Ningbo (CN)

(72) Inventor: Xudong Feng, Ningbo (CN)

( * ) Notice: Subject to any disclaimer, the term of this patent is extended or adjusted under 35 U.S.C. 154(b) by 15 days.

(21) Appl. No.: 17/829,352

(22) Filed: May 31, 2022

(65) Prior Publication Data

US 2023/0381681 A1 Nov. 30, 2023

(51) Int. Cl.
*A63H 33/08* (2006.01)

(52) U.S. Cl.
CPC ..... *A63H 33/086* (2013.01)

(58) Field of Classification Search
CPC ..... A63H 33/086
USPC ..... D21/485–505; 446/85–128
See application file for complete search history.

(56) References Cited

U.S. PATENT DOCUMENTS 3,162,973 A * 12/1964 Godtfred ..... A63H 33/086 446/128
3,274,727 A * 9/1966 Werner ..... A63F 9/06 428/49
D213,385 S * 2/1969 Molenaar ..... D21/488
D219,230 S * 11/1970 Reigchard ..... D21/491
3,589,056 A * 6/1971 Glass ..... A63H 33/108 385/88
3,594,940 A * 7/1971 Yonezawa ..... A63H 33/04 446/96
3,748,752 A * 7/1973 Quercetti ..... A63F 9/06 434/96
4,164,091 A * 8/1979 Lin ..... A63H 33/108 446/124
4,183,167 A * 1/1980 Jatich ..... A63F 9/06 446/118
4,270,303 A * 6/1981 Xanthopoulos ..... A63H 33/086 446/128
4,390,101 A * 6/1983 Humphreys ..... H05K 7/1418 211/41.17
4,550,539 A * 11/1985 Foster ..... A47B 73/006 52/844
D284,611 S * 7/1986 Cotney ..... D21/485
D285,592 S * 9/1986 Kushner ..... D21/526
4,728,310 A * 3/1988 Valtolina ..... A63H 33/107 446/128
4,813,904 A * 3/1989 Larws ..... A63H 33/088 446/108

(Continued)

FOREIGN PATENT DOCUMENTS

DE 202017107914 U1 * 2/2018 ..... A63H 33/08

OTHER PUBLICATIONS

Delsun, Machine Translation of DE202017107914 U1, uploaded Aug. 7, 2023, Espacenet, 4 pages.*

*Primary Examiner* — Eugene L Kim
*Assistant Examiner* — Matthew B Stanczak
(74) *Attorney, Agent, or Firm* — David & Raymond Patent Firm; Raymond Y Chan

(57) ABSTRACT

A surface grid panel assembly includes a grid panel and a plurality of attachment studs formed thereon. The grid panel includes a plurality of first and second grid members intersecting with each other. The attachment studs are spacedly protruded from top surfaces of the first and second grid members of the grid panel, wherein one or more attachment elements are adapted for detachably coupling with the attachment studs to couple the attachment elements on the grid panel.

11 Claims, 7 Drawing Sheets

(56) References Cited

U.S. PATENT DOCUMENTS 4,891,030 A * 1/1990 Gertzfeld ..... A63F 9/10 446/124
4,964,802 A * 10/1990 Weller ..... A63F 9/06 434/96
4,986,756 A * 1/1991 Yamaguchi ..... A63F 9/06 434/96
4,988,322 A * 1/1991 Knudsen ..... A41G 1/007 446/120
5,174,757 A * 12/1992 Jones ..... G09B 19/10 446/107
5,328,374 A * 7/1994 Stevens ..... G09B 23/04 434/211
D352,749 S * 11/1994 Ryaa ..... D21/489
D353,639 S * 12/1994 Ryaa ..... D21/491
D357,512 S * 4/1995 Ishikawa ..... D21/491
D357,513 S * 4/1995 Ishikawa ..... D21/491
5,421,270 A * 6/1995 Kelly ..... A47B 13/16 108/159
D370,035 S * 5/1996 Olsen ..... D21/491
D377,671 S * 1/1997 Gabriel ..... D21/500
D385,926 S * 11/1997 Nielsen ..... D21/485
5,876,262 A * 3/1999 Kelly ..... A63H 33/22 108/23
D410,976 S * 6/1999 Poulsen ..... D21/489
D412,189 S * 7/1999 Poulsen ..... D21/502
5,993,283 A * 11/1999 Cyrus ..... A63H 33/086 446/124
D422,035 S * 3/2000 Cyrus ..... D21/501
6,634,920 B1 * 10/2003 Michaelsen ..... A63H 33/04 446/128
D553,200 S * 10/2007 Glickman ..... D21/485
7,416,166 B1 * 8/2008 Shaw ..... B60P 3/36 446/128
D614,250 S * 4/2010 Frederiksen ..... D21/501
D704,776 S * 5/2014 Capriola ..... D21/522
8,986,012 B1 * 3/2015 McGee ..... G09B 23/02 434/211
D731,596 S * 6/2015 Jensen ..... D21/491
D731,599 S * 6/2015 Pilgaard ..... D21/504
D736,862 S * 8/2015 Karunaratne ..... D21/501
9,220,993 B1 * 12/2015 Alsaleh ..... A63H 33/08
D748,203 S * 1/2016 Karunaratne ..... D21/491
9,345,981 B1 * 5/2016 Lama ..... A63H 33/086
9,480,931 B1 * 11/2016 Samo ..... A63H 33/065
9,517,423 B1 * 12/2016 Kanbar ..... A63H 33/084
D829,829 S * 10/2018 Barwald ..... D21/491
D829,830 S * 10/2018 Wakim ..... D21/491
10,272,352 B2 * 4/2019 Chazen ..... A63H 33/14
D849,851 S * 5/2019 Pihl ..... D21/619
D851,180 S * 6/2019 Pihl ..... D21/491
D857,111 S * 8/2019 Pihl ..... D21/485
10,596,480 B1 * 3/2020 Samo ..... A63H 33/065
D928,789 S * 8/2021 Guzman ..... D14/441
D936,153 S * 11/2021 Wang ..... D21/491
D936,154 S * 11/2021 Wang ..... D21/485
D945,534 S * 3/2022 Lo ..... D21/489
2005/0048867 A1 * 3/2005 Cyrus ..... A63H 33/04 446/110
2005/0227573 A1 * 10/2005 Lin ..... A63F 9/1044 446/85
2006/0048475 A1 * 3/2006 Lin ..... A63H 33/088 52/589.1
2006/0166590 A1 * 7/2006 Ishikawa ..... A63H 33/086 446/120
2007/0060010 A1 * 3/2007 Richdale ..... A63H 33/044 446/85
2008/0090485 A1 * 4/2008 Glickman ..... A63H 33/082 446/120
2013/0026337 A1 * 1/2013 Svensson ..... B29C 33/30 249/98
2015/0298019 A1 * 10/2015 Sokolov ..... A63H 33/086 446/124
2015/0314209 A1 * 11/2015 Brooks ..... A63H 3/46 446/128
2017/0263155 A1 * 9/2017 Broms ..... A63H 33/042
2019/0143236 A1 * 5/2019 Cecchin ..... H01R 39/64 446/90
2019/0184276 A1 * 6/2019 Chazen ..... A63F 9/1044

* cited by examiner

SURFACE GRID PANEL ASSEMBLY

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a toy building block, and more particularly to a surface grid panel assembly, which provides a plurality of attachment studs spacedly formed a grid platform for one or more functional elements detachably coupling thereon.

Description of Related Arts

Children enjoy playing and interacting with toys and building elements. Generally, toy building block sets are well known and are considered as one of learning tools for improving children learning and development process. The toy building block set generally comprises a plurality of building blocks arranged to detachably couple with each other. By configuring different sizes and shapes of the building blocks, children can use their imagination and creativity to combine the building blocks for forming different block products. However, there is a major drawback of the toy building block set that the building blocks can only interlock with each other.

It would be desirable to provide a building plate for detachably coupling different building blocks and/or different block products on the building plate. The conventional building plate generally comprises a base plate made of rigid material and a plurality of coupling studs spacedly protruded therefrom. However, the conventional building plate has several drawbacks that it is relatively heavy and the size is not customizable.

SUMMARY OF THE PRESENT INVENTION

The invention is advantageous in that it provides a surface grid panel assembly, which provides a plurality of attachment studs spacedly formed a grid platform for one or more functional elements detachably coupling thereon.

Another advantage of the invention is to provide a surface grid panel assembly, wherein the grid platform is constructed to have a plurality of first and second grid members intersecting with each other, so as to enhance a structural strength of the grid platform and to reduce the overall weight of the surface grid panel assembly.

Another advantage of the invention is to provide a surface grid panel assembly, wherein the attachment studs are adapted to incorporate with any existing attachment unit to be detachably coupled on the grid platform.

Another advantage of the invention is to provide a surface grid panel assembly, wherein the attachment studs are configured to have a plurality of solid studs and a plurality of hollow studs for coupling with different fittings of the attachment units.

Another advantage of the invention is to provide a surface grid panel assembly, wherein each of the first and second grid members is configured to have a T-shaped cross section so as to further enhance the structural strength of the grid platform.

Another advantage of the invention is to provide a surface grid panel assembly, wherein the grid platforms are stackable with each other.

Another advantage of the invention is to provide a surface grid panel assembly, wherein the grid platform is made of cuttable material, such that the size and shape of the grid platform is customizable.

Another advantage of the invention is to provide a surface grid panel assembly, wherein different functional units are detachably coupled on the grid platform to retain the functional unit thereon.

Another advantage of the invention is to provide a surface grid panel assembly, which does not require altering the original structural design of the attachment unit, so as to minimize the manufacturing cost of the attachment unit that incorporates the surface grid panel assembly.

Another advantage of the invention is to provide a surface grid panel assembly, wherein no expensive or complicated structure is required to employ the present invention in order to achieve the above mentioned objectives. Therefore, the present invention successfully provides an economic and efficient solution to provide a rigid and customizable grid platform for retaining a product and/or attachment units thereon.

Additional advantages and features of the invention will become apparent from the description which follows, and may be realized by means of the instrumentalities and combinations particular point out in the appended claims.

According to the present invention, the foregoing and other objects and advantages are attained by a surface grid panel assembly for one or more attachment elements, comprising:

- a grid platform comprising a plurality of first and second grid members intersecting with each other, wherein each of the first and second grid members has a top surface and a bottom surface; and
- a plurality of attachment studs spacedly protruded from the top surfaces of the first and second grid members for detachably coupling with the one or more attachment elements.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 8:
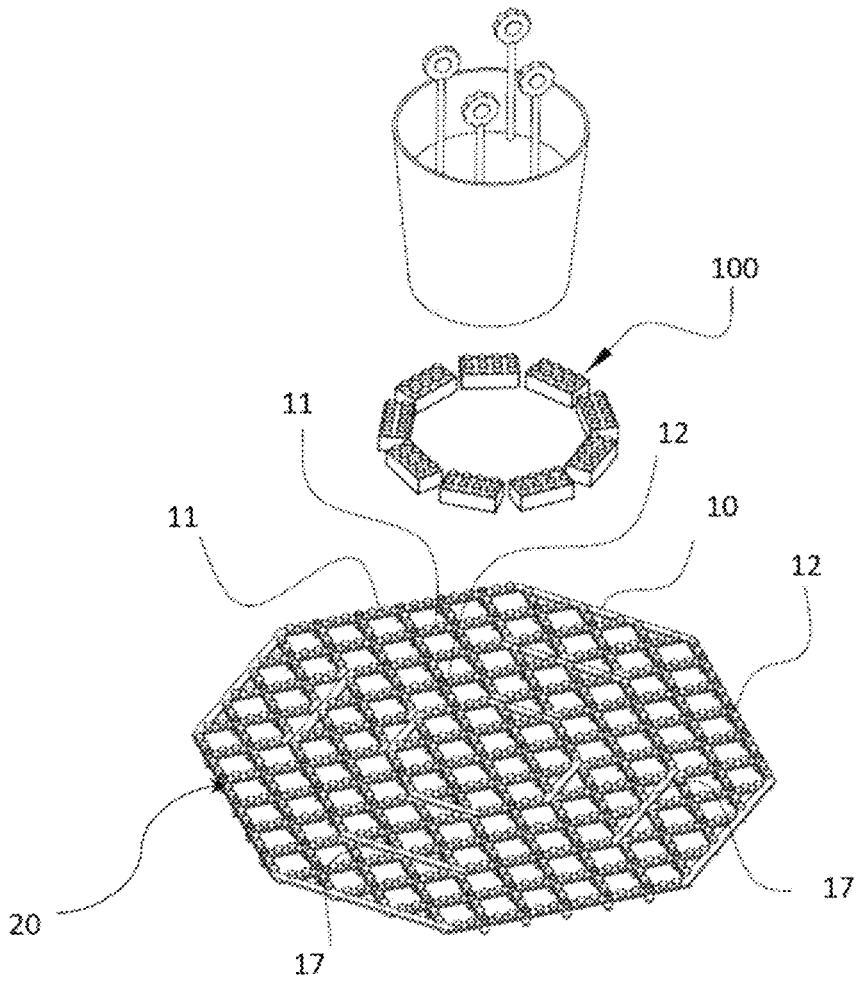
FIG. 8 is a perspective view of the surface grid panel assembly according to the above preferred embodiment of the present invention, illustrating the attachment units coupling on the surface grid panel assembly.

Referring to FIGS. 1 to 4 of the drawings, a surface grid panel assembly according to a preferred embodiment of the present invention is illustrated, wherein one or more attachment units 100 or an object can be detachably held on the surface grid panel assembly as shown in FIG. 8. Accordingly, the surface grid panel assembly comprises a grid platform 10 and a plurality of attachment studs 20.

Figure 7:
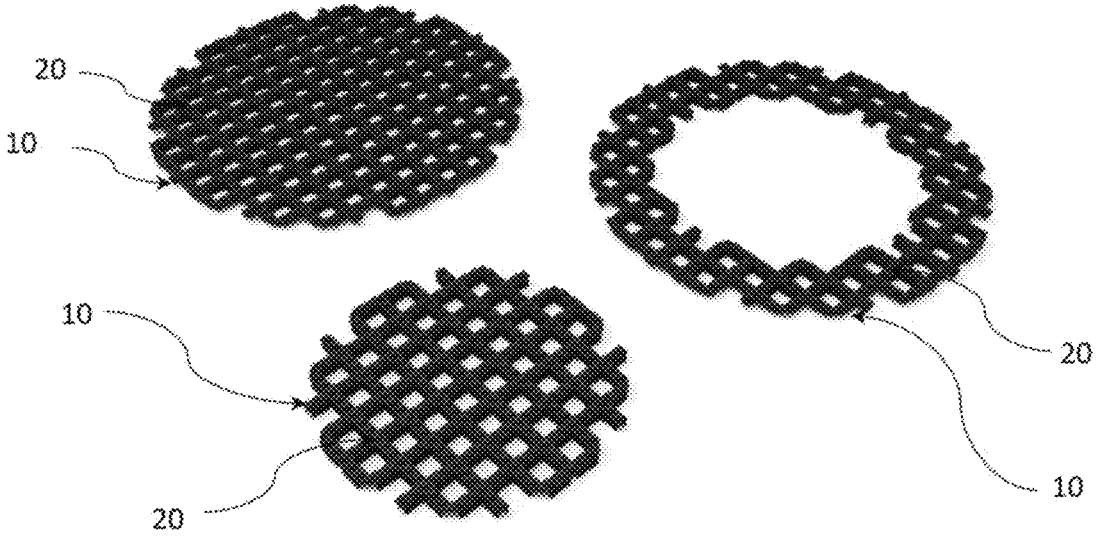
FIG. 7 is a perspective view of the surface grid panel assembly according to the above preferred embodiment of the present invention, illustrating different customized surface grid panel assemblies.

The grid platform 10 comprises a plurality of first and second grid members 11, 12 intersecting with each other to form a plurality of intersection points 101. The first and second grid members 11, 12 are identical is shape. Each of the first and second grid members 11, 12 has a top surface and a bottom surface. In other words, the top surface of each of the first and second grid members 11, 12 is the top surface of the grid platform 10, while the bottom surface of each of the first and second grid members 11, 12 is the bottom surface of the grid platform 10. As shown in FIG. 7, the grid platform 10 is made of rigid but cuttable material, wherein each of the first and second grid members 11, 12 are adapted to be cut to custom a size and shape of the grid platform 10. Accordingly, the grid platform 10 is constructed to have a grid structure to reduce the overall weight of the surface grid panel assembly.

The attachment studs 20 are spacedly protruded from the top surfaces of the first and second grid members 11, 12 for detachably coupling with the one or more attachment elements 100. Accordingly, the attachment studs 20 are configured to have identical size and shape.

As shown in FIGS. 1 to 4, the first and second grid members 11, 12 are elongated straight members and are integrally extended with each other, such that the top surfaces of the first and second members 11, 12 are integrally extended to form a top grid surface of the grid platform 10. In one embodiment, the first and second grid members 11, 12 are intersected and perpendicular to each other. In other words, the first and second grid members 11, 12 are intersected and formed right angles.

Figure 4:
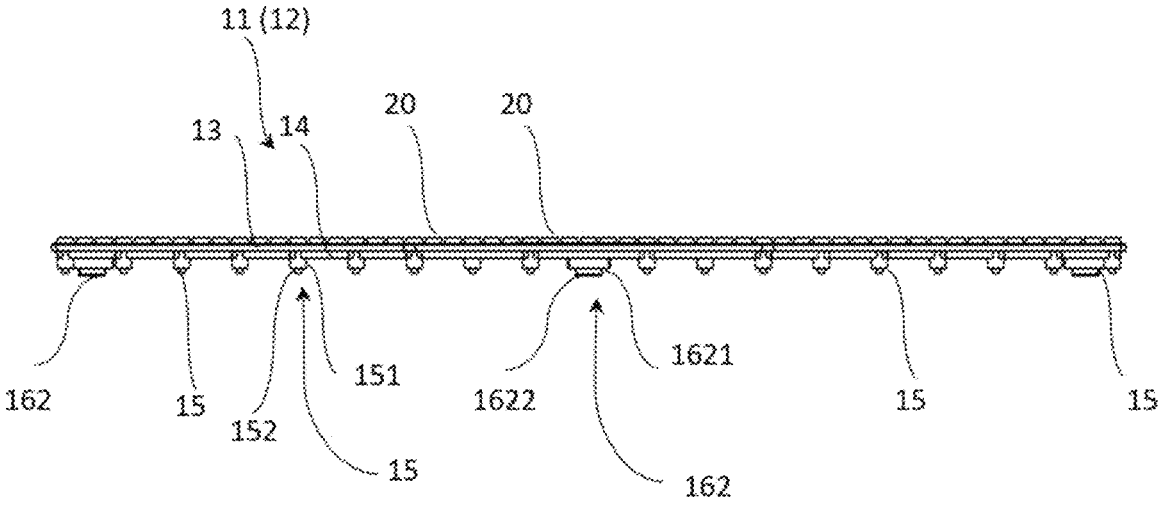
FIG. 4 is a side view of the surface grid panel assembly according to the above preferred embodiment of the present invention.
Figure 6:
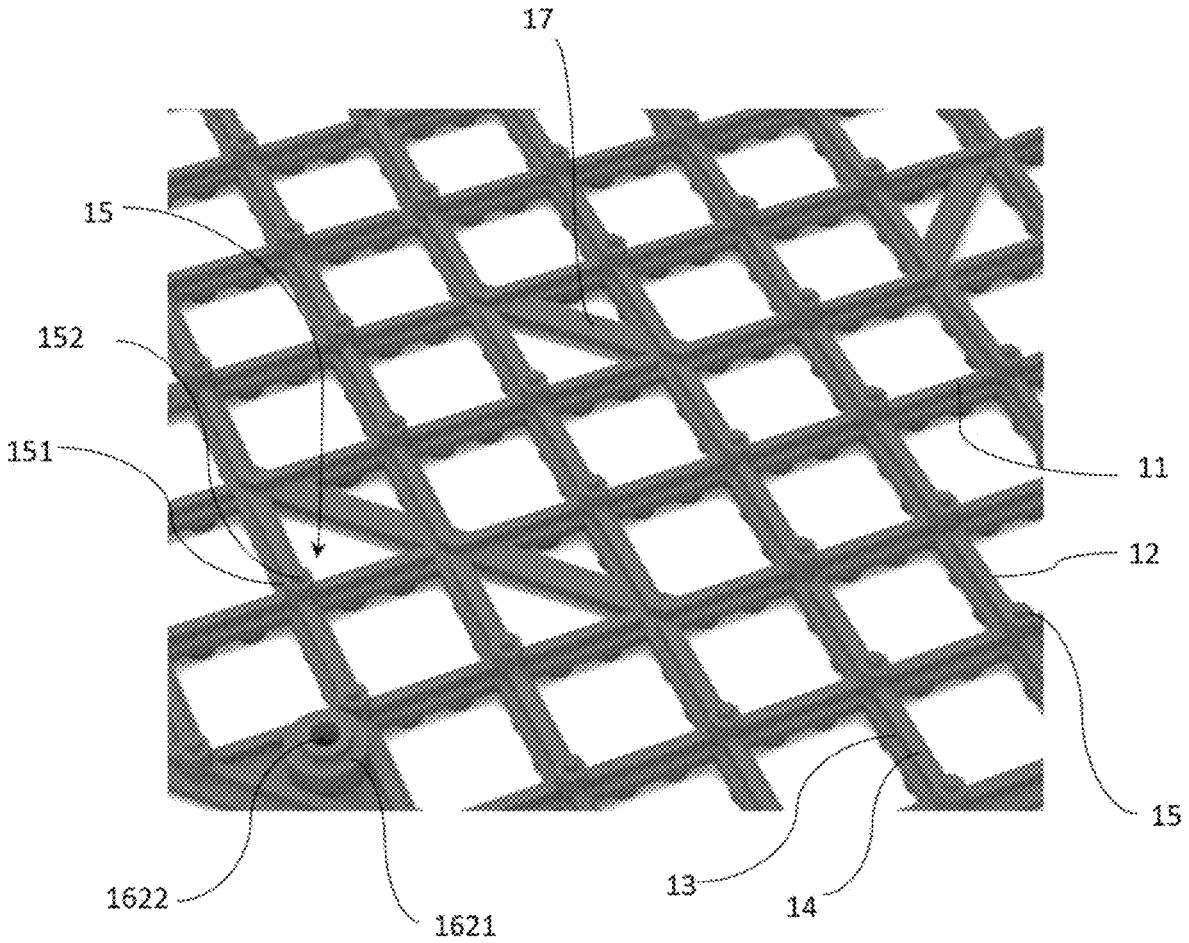
FIG. 6 is a partially enlarged bottom perspective view of the surface grid panel assembly according to the above preferred embodiment of the present invention, illustrating the protruding couplers.

As shown in FIGS. 4 and 6, each of first and second grid members 11, 12, having a T-shaped cross section, comprises an upper supporting platform 13 and a lower reinforcing rib 14 integrally extended from a bottom side of the supporting platform 13. Accordingly, a width of the supporting platform 13 is larger than a width of the reinforcing rib 14, wherein the reinforcing rib 14 is extended along a centerline of the supporting platform 13 at the bottom side thereof. The T-shaped first and second grid members 11, 12 will enhance the structural strength of the grid platform 10.

Figure 2:
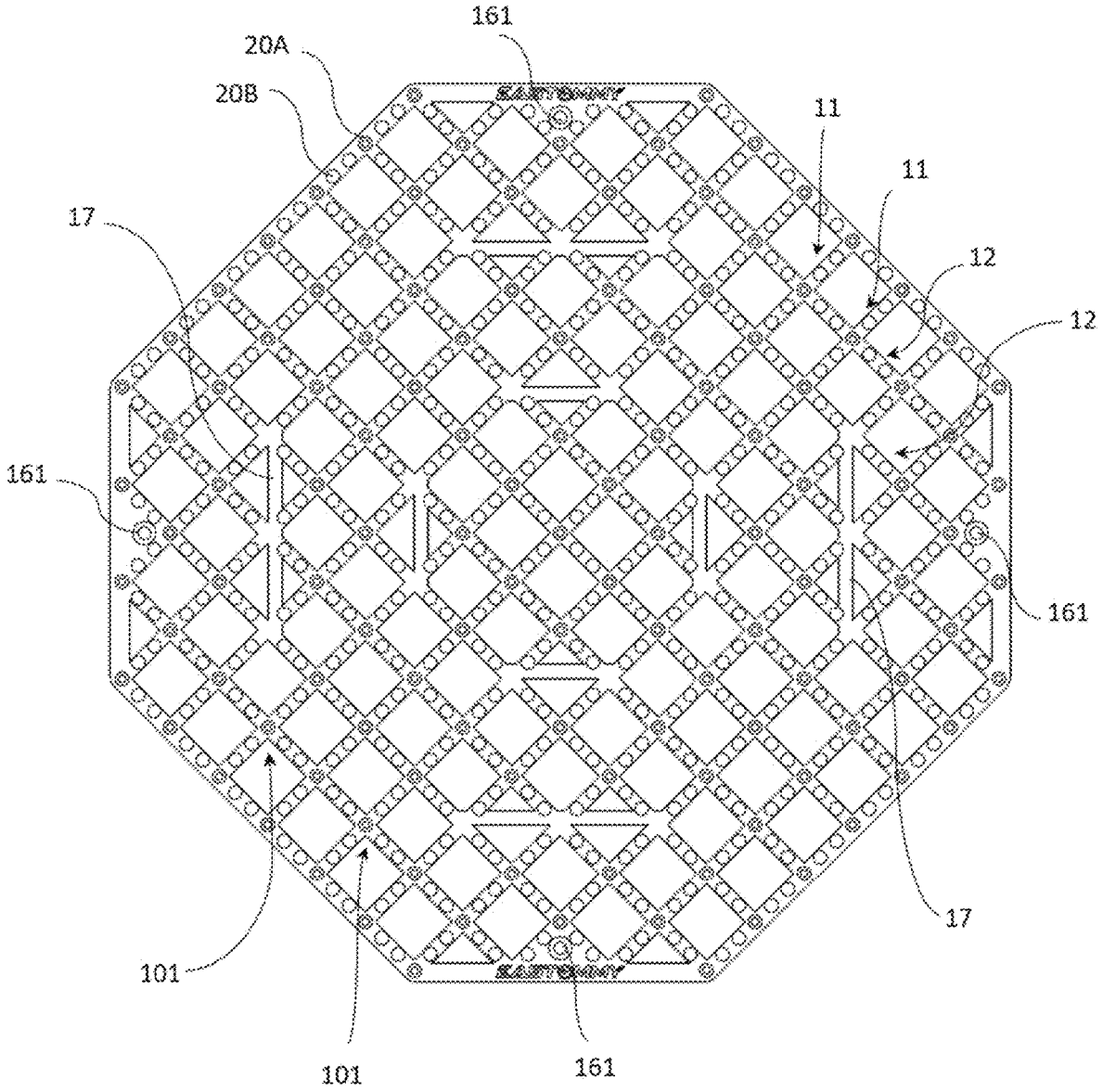
FIG. 2 is a top view of the surface grid panel assembly according to the above preferred embodiment of the present invention.
Figure 5:
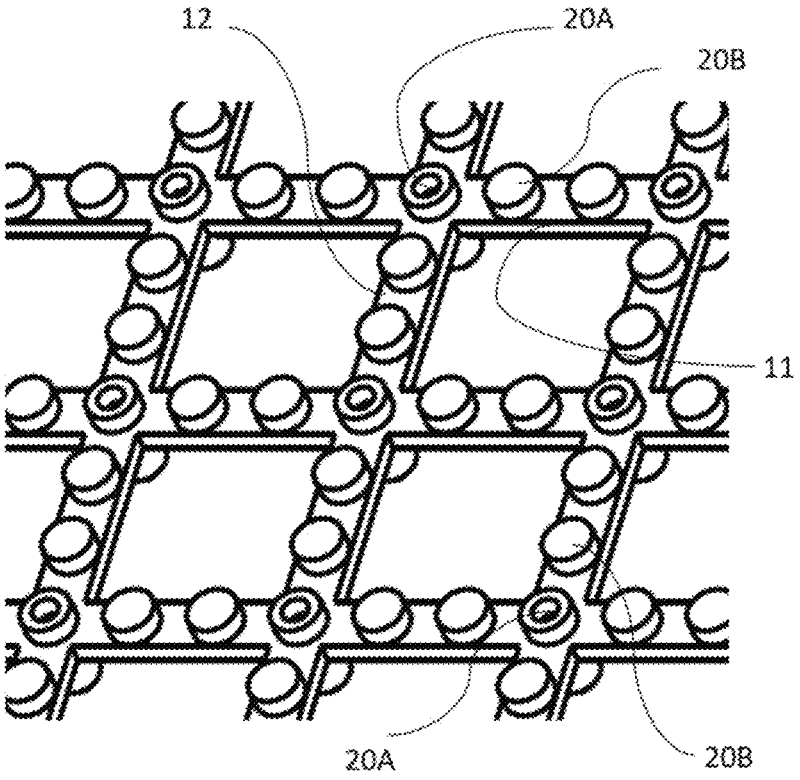
FIG. 5 is a partially enlarged top perspective view of the surface grid panel assembly according to the above preferred embodiment of the present invention, illustrating the hollow studs and the solid studs.

As shown in FIGS. 2 and 5, the attachment studs 20 are integrally extended from the top surfaces of the first and second grid members 11, 12. Particularly, the attachment studs 20 are integrally formed on the supporting platforms 13 of the first and second grid members 11, 12. Preferably, a diameter of each of the attachment studs 20 is slightly smaller than the width of the supporting platform 13. In one embodiment, the surface grid panel assembly is made by mold injection to integrally form the attachment studs 20, and the first and second grid members 11, 12 of the grid platform 10 together as a one piece integrated member.

According to the preferred embodiment, the attachment studs 20 located at the intersection points 101 of the first and second grid members 11, 12, serving as a plurality of hollow studs 20A. On the other hand, the attachment studs 20 located at non-intersection points of the first and second grid members 11, 12 serving as a plurality of solid studs 20B. Each of the hollow studs 20A has a closed hollow structure which has a top opening end and a bottom closed end. Each of the solid studs 20B is a solid member which has a top closed end. It is worth mentioning that the non-intersection points of the first and second grid members 11, 12 are defined at any top surface thereof except the intersection points 101. Therefore, the numbers of solid studs 20B should be more than the numbers of hollow studs 20A. In one embodiment as shown in FIG. 5, two spaced apart solid studs 20B are located between two of the hollow studs 20A. Via the hollow studs 20A and the solid studs 20B, different fittings of the attachment units 100 can be detachably coupled on the top grid surface of the grid platform 10. Furthermore, glue can be filled into the hollow studs 20A to securely affix the attachment units 100 on the top grid surface of the grid platform 10.

As shown in FIGS. 4 and 6, the grid platform 10 further comprises a plurality of protruding couplers 15 downwardly extended from the bottom surfaces of the first and second grid members 11, 12. Accordingly, the protruding couplers 15 are downwardly extended from the first and second grid members 11, 12 at the intersection points thereof, wherein when two of the grid platforms 10 are stacked, the protruding couplers 15 at the upper grid platform 10 are engaged with the hollow studs 20A at the lower grid platform so as to securely couple the grid platforms 10 in a stacked manner.

Particularly, each of the protruding couplers 15 comprises a first cylindrical post 151 integrally extended from the bottom surface of each of the first and second grid members 11, 12, and a second cylindrical post 152 integrally and coaxially extended from the first cylindrical post 151. A diameter of the first cylindrical post 151 is larger than a diameter of the second cylindrical post 152. The diameter of the first cylindrical post 151 matches with an outer diameter size of the hollow studs 20A. The diameter of the second cylindrical post 152 matches with an inner diameter size of the hollow studs 20A. Therefore, when the second cylindrical post 152 is inserted into the hollow studs the first cylindrical post 151 is sat on the hollow studs 20A to support stacked grid platforms 10 in a spacing manner.

Preferably, the grid platform 10 further comprises a coupler unit 16 which comprises a plurality of first aligning couplers 161 formed on the top surfaces of the first and second grid members 11, 12 and a plurality of second aligning couplers 162 formed on the bottom surfaces of the first and second grid members 11, 12, wherein the first and second aligning couplers 161, 162 are detachably coupled with each other to align the grid platforms 10 in a stacked manner. In one embodiment, the first aligning couplers 161 are coupling holes spacedly formed at a peripheral edge of the grid platform 10 at the top surface thereof. The second aligning couplers 162 are coupling posts spacedly formed at the peripheral edge of the grid platform 10 at the bottom surface thereof. Likewise, each of the second aligning couplers 162 comprises an upper cylindrical coupler 1621 integrally extended from the bottom surface of the grid platform 10 and a lower cylindrical coupler 1622 integrally, coaxially and downwardly extended from the upper cylindrical coupler 1621, wherein a diameter of the upper cylindrical coupler 1621 is larger than a diameter of the lower cylindrical coupler 1622. The diameter of the lower cylindrical coupler 1622 matches with a diameter of the coupling hole of the first aligning coupler 161. Therefore, when the lower cylindrical coupler 1622 is inserted into the coupling hole of the first aligning coupler 161, the upper cylindrical coupler 1621 is sat on the coupling hole of the first aligning coupler 161 to support stacked grid platforms 10 in a spacing manner. It is worth mentioning that the first and second aligning couplers 161, 162 are located at the peripheral edge of the grid platform 10 to enable the grid platforms 10 being easily stacked and coupled with each other. In one embodiment, as shown in FIG. 4, the diameter of the upper cylindrical coupler 1621 is larger than the diameter of the first cylindrical post 151, wherein a height of the upper cylindrical coupler 1621 matches with a height of the first cylindrical post 151. The diameter of the lower cylindrical coupler 1622 is larger than the diameter of the second cylindrical post 152, wherein a height of the lower cylindrical coupler 1622 matches with a height of the second cylindrical post 152. Preferably, there are four first aligning couplers 161 formed on the top surfaces of the first and second grid members 11, 12 and four second aligning couplers 162 formed on the bottom surfaces of the first and second grid members 11, 12.

Figure 1:
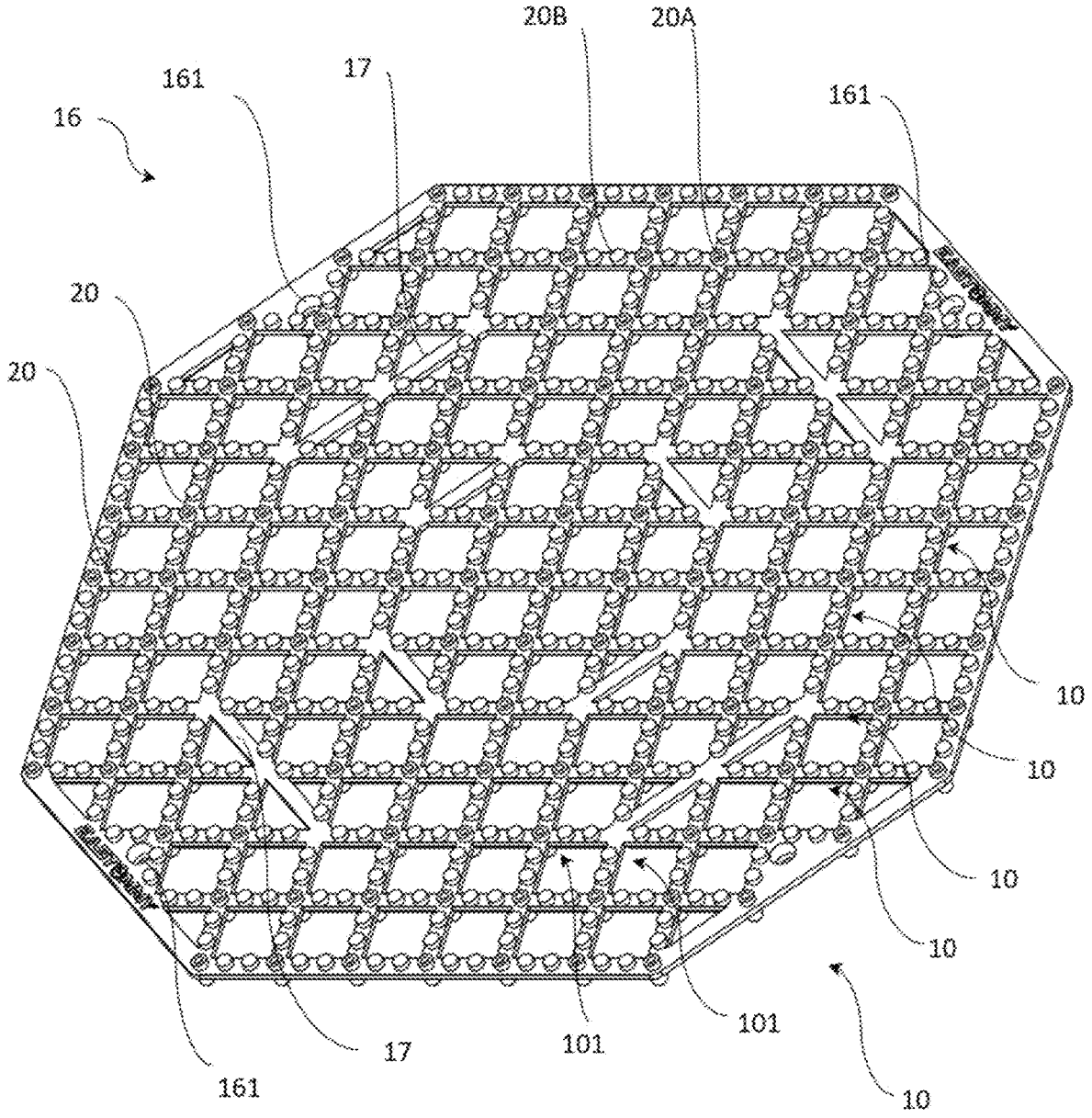
FIG. 1 is a perspective view of a surface grid panel assembly according to a preferred embodiment of the present invention.
Figure 3:
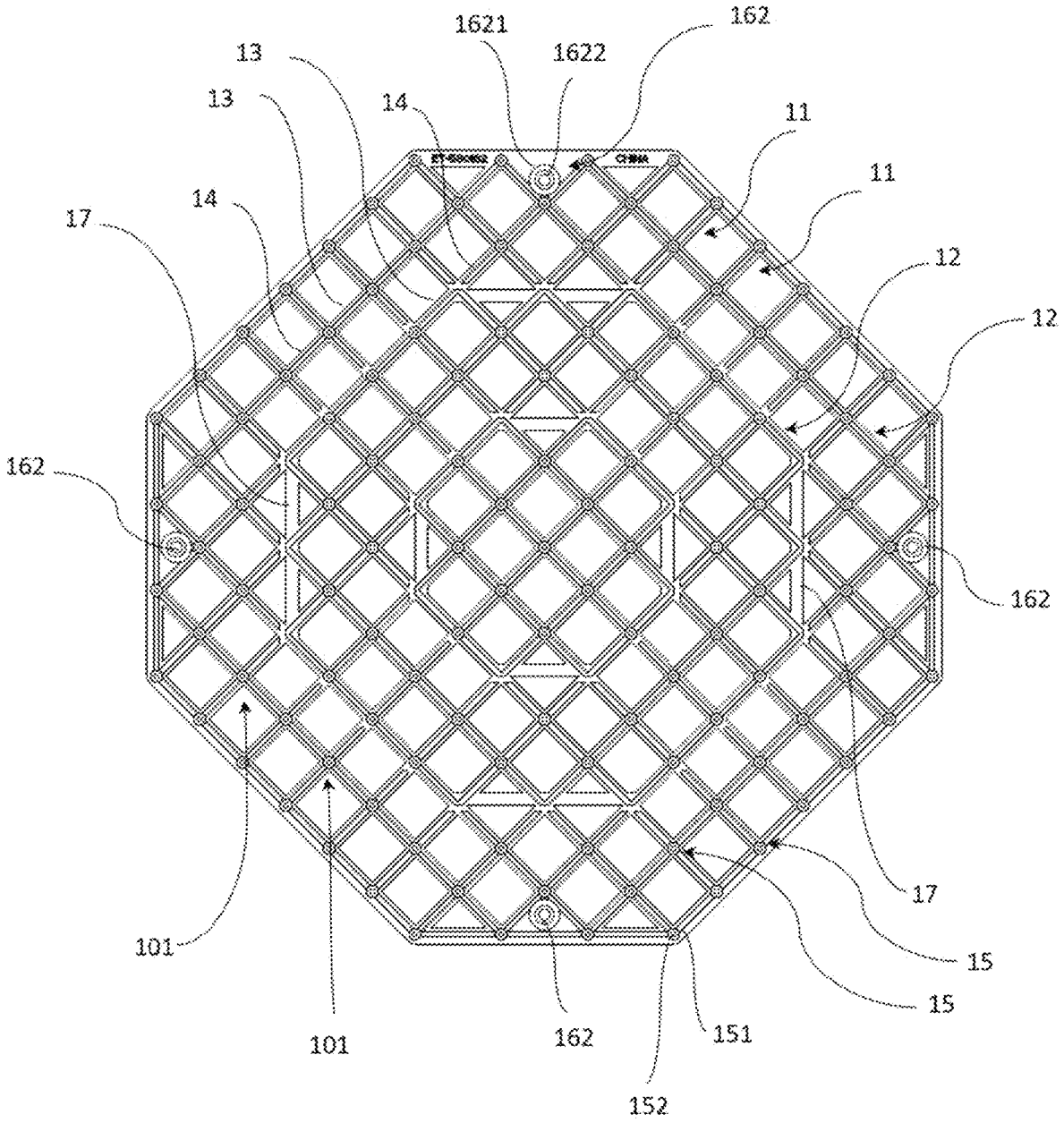
FIG. 3 is a bottom view of the surface grid panel assembly according to the above preferred embodiment of the present invention.

As shown in FIGS. 1 to 3, the grid platform 10 further comprises a plurality of reinforcing members 17, wherein each of the reinforcing members 17 is integrally extended between two intersection points 101 of the first and second grid members 11, 12 to reinforce the structure of the grid platform 10. Accordingly, the first grid members 11, the second grid members 12, and the reinforcing members 17 form a plurality of triangular configuration on the grid platform 10 to enhance the structure of the grid platform 10. Preferably, no attachment stud 20 is formed at the intersection point 101 where the reinforcing member 17 is extended thereto.

As shown in FIG. 8, the attachment units 100 are detachably coupled on the grid platform 10 to form a holding frame to retain a pot or container thereon. In other words, the grid platform 10 serves as an interlocking platform to interlock with the attachment units 100 and serves as a supporting platform to support the object, such as the pot or container.

Figure 9:
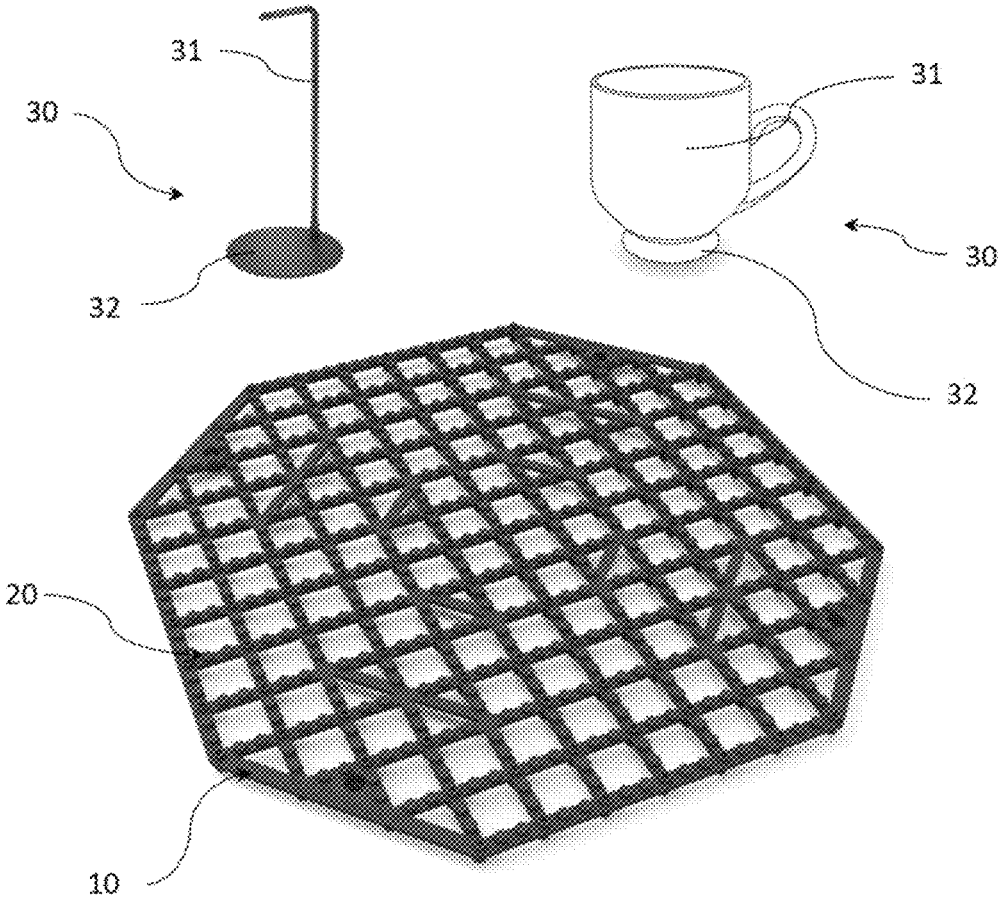
FIG. 9 is a perspective view of the surface grid panel assembly according to the above preferred embodiment of the present invention, illustrating the functional unit coupling on the surface grid panel assembly.

As shown in FIG. 9, the surface grid panel assembly further comprises one or more functional units 30 detachably coupled on the grid platform 10. Accordingly, each of the function units 30 comprises a top functional element 31 and a bottom fitting 32 detachably coupled at the attachment studs 20 to retain the functional element 31 on the grid platform 10. In one example, the function element 31 is embodied as a hook, wherein when the bottom fitting 32 is detachably coupled at the attachment studs 20, the hook of the functional element 31 is retained on the grid platform 10. In another example, the function element 31 is embodied as a container, wherein when the bottom fitting 32 is detachably coupled at the attachment studs 20, the container of the functional element 31 is retained on the grid platform 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A surface grid panel assembly, comprising:

a grid platform comprising a plurality of first grid members, a plurality of second grid members and a plurality of reinforcing members, wherein said plurality of first grid members and said plurality of second grid members are intersected with each other to form a plurality of intersection points, wherein each of said first grid members and said second grid members has a top surface and a bottom surface, wherein said plurality of first grid members and said plurality of second grid members are elongated straight members and integrally extended with each other, such that said top surfaces of said plurality of first grid members and said plurality second grid members are intersected integrally extended to form a top grid surface of said grid platform, wherein each of said plurality of first grid members and said plurality of second grid members, having a T-shaped cross section, comprises an upper supporting platform and a lower reinforcing rib integrally extended from a bottom side of said supporting platform, wherein a width of said supporting platform is larger than a width of said reinforcing rib and said reinforming rib is extended along a centerline of said supporting platform at said bottom side thereof, wherein each of said reinforcing members is integrally extended between two of said intersection points of said plurality of first grid members and said plurality of second grid members to reinforce said grid platform, wherein said plurality of said first grid members, said plurality of second grid members and said plurality of reinforcing members form a plurality of triangular configuration on said grid platform; and a plurality of attachment studs spacedly protruded from said top surfaces of said plurality of first grid members and said plurality of second grid members, wherein said plurality of attachment studs located at intersection points of said plurality of first grid members and said plurality of second grid members serving as a plurality of hollow studs while said plurality of attachment studs located at non-intersection points of said plurality of first grid members and said plurality of second grid members serving as a plurality of solid studs.

2. The surface grid panel assembly, as recited in claim 1, further comprising one or more attachment elements detachably coupling with said plurality of attachment studs of said top surfaces of said plurality of first grid members and said plurality of said second grid members.

3. The surface grid panel assembly, as recited in claim 1, wherein said grid platform further comprises a plurality of protruding couplers downwardly extended from said bottom surfaces of said plurality of first grid members and said plurality of second grid members, wherein said plurality of protruding couplers are configured for engaging with said hollow studs of another grid platform of said surface grid panel assembly.

4. The surface grid panel assembly, as recited in claim 3, wherein said grid platform further comprises a coupler unit which comprises a plurality of first aligning couplers formed on said top surfaces of said plurality of first grid members and said plurality of second grid members and a plurality of second aligning couplers formed on said bottom surfaces of said plurality of first grid members and said plurality of second grid members, wherein said first aligning couplers and said second aligning couplers are able to be detachably coupled with each other for aligning two or more of said grid platforms in a stacked manner.

5. The surface grid panel assembly, as recited in claim 3, wherein each of said protruding couplers comprises a first cylindrical post integrally extended from said bottom surface of each of said first and second grid members, and a second cylindrical post integrally and coaxially extended from said first cylindrical post, wherein a diameter of said first cylindrical post is larger than a diameter of said second cylindrical post.

6. The surface grid panel assembly, as recited in claim 5, wherein said grid platform is made of rigid but cuttable material, such that each of said first and second grid members are adapted to be cut to custom a size and shape of said grid panel.

7. The surface grid panel assembly, as recited in claim 6, further comprising one or more functional units, wherein each of said one or more function units comprises a top functional element and a bottom fitting detachably coupled at said attachment studs to retain said one or more functional units element on said grid platform.

8. The surface grid panel assembly, as recited in claim 7, wherein said plurality of first grid members and said plurality of second grid members are intersected and perpendicular to each other.

9. The surface grid panel assembly, as recited in claim 1, wherein said grid platform is made of rigid but cuttable material, such that each of said first and second grid members are adapted to be cut to custom a size and shape of said grid panel.

10. The surface grid panel assembly, as recited in claim 1, further comprising one or more functional units, wherein each of said one or more function units comprises a top functional element and a bottom fitting detachably coupled at said attachment studs to retain said one or more functional units on said grid platform.

11. The surface grid panel assembly, as recited in claim 1, wherein said plurality of first grid members and said plurality of second grid members are intersected and perpendicular to each other.

* * * * *